United States Patent [19]

Bolton

[11] 4,329,201

[45] May 11, 1982

[54] CONSTANT VACUUM FELT DEWATERING SYSTEM

[75] Inventor: Joseph A. Bolton, Glens Falls, N.Y.

[73] Assignee: Albany International Corp., Menands, N.Y.

[21] Appl. No.: 100,814

[22] Filed: Dec. 6, 1979

[51] Int. Cl.[3] ..... D21F 11/00; D21F 1/48

[52] U.S. Cl. ..... 162/198; 15/302; 15/306 R; 15/306 A; 134/18; 134/21; 162/199; 162/252; 162/274

[58] Field of Search ..... 162/199, 252, 279, 366, 162/274, 364, 253, 198; 134/15, 18, 21, 155, 160, 43, 92; 15/306 A, 306 R, 319, 302

[56] References Cited

U.S. PATENT DOCUMENTS

| | | | |
|---|---|---|---|
| 2,745,322 | 5/1956 | Broughton | 162/252 |
| 2,965,168 | 12/1960 | Beachler | 162/253 |
| 3,631,982 | 1/1972 | Lejeune | 162/253 |
| 3,836,428 | 9/1974 | McConaughy | 162/279 |
| 3,859,163 | 1/1975 | Haythornthwaite | 162/279 |

FOREIGN PATENT DOCUMENTS

| | | | |
|---|---|---|---|
| 565964 | 7/1977 | U.S.S.R. | 162/279 |

*Primary Examiner*—Peter Chin

*Attorney, Agent, or Firm*—Kane, Dalsimer, Kane, Sullivan and Kurucz

[57] ABSTRACT

A constant vacuum felt dewatering system including first and second suction pipes with a slot in each pipe. A felt is positioned to pass over the slots of the pipes. A liquid ring pump is connected by conduits to the first and second suction pipes. Drive structure is provided to operate the liquid ring pump and apply suction to the first and second suction pipes. The felt is advanced over the pipes whereupon suction is applied thereto to dewater the felt. Controls are responsive to change in felt conditions to vary the dwell time of the felt with respect to the slots in order to maintain a substantially constant vacuum.

12 Claims, 4 Drawing Figures

CONSTANT VACUUM FELT DEWATERING SYSTEM

BACKGROUND OF THE INVENTION

It is conventional in the papermaking industry to use suction pipe systems and in particular suction pipes with elongated slots in alignment with a felt. Each suction pipe is positioned so that the felt passes over the slot and the suction causes dewatering of the felt. The water collects within the suction pipe and is directed to an appropriate collection location. Suitable separators can be employed to facilitate collection of the water drawn from the felt by the vacuum dewatering system.

There are several basic types of vacuum pumps presently used in dewatering systems with the choice being dependent on a variety of parameters including cost, machine deficiency and the type of papermaking machinery being utilized. Three basic types of vacuum pumps used in the paper industry are the liquid ring pump, the positive displacement pump, and the centrifugal exhauster or blower. Each type has its advantages and disadvantages with respect to one another and different maximum efficiency values on air flow versus vacuum settings. Therefore, it is important to select not only a particular type of vacuum pump for a given application, but also with size, port openings, number of stages, and other criteria, for the lowest horsepower for unit air flow requirement. Lower horsepower naturally reduces manufacturing, assembly and use costs as well as producing lower energy consumption which is of extreme concern today.

Other factors that always have to be considered in the selection of a vacuum pump system besides the lower horsepower requirements are purchase price, total installation cost, maintenance, seal water requirements, amount of liquid with incoming air flow, and presence of contamination such as solids or fibers. In other words, one type of vacuum pump may look good from a horsepower standpoint, but because of the above other considerations, may not be practical or the total system cost may be more expensive than using another type pump.

In considering the above parameters, an important balancing criteria is based upon sufficient power to permit the use of a felt for dewatering purposes over the longest possible time before replacement is required. It is well known that the felt will wear over a period of time in use and will ultimately have to be replaced. However, the felt also undergoes a reduction in permeability as it is used over a period of time for dewatering purposes. This reduction in permeability naturally affects the efficiency of the dewatering system. Consequently, vacuum pumps of substantial horsepower are utilized in present dewatering systems so that the felts can be used for a longer period of time even after the permeability has been substantially reduced. Naturally the larger horsepower vacuum pump is considerably over sized for the system when the felt is new causing the system to be inefficient and more costly than necessary during a substantial portion of the time a felt is employed. It is only when the permeability has been reduced sufficiently for the additional horsepower to be needed that it is utilized.

Alternatively, felts can be more frequently replaced but this is a costly and time consuming procedure which is undesirable in the industry.

It should also be noted that even with the oversized vacuum pump in regard to horsepower, the additional horsepower is often not sufficient to effectively dewater with the use of a single suction pump and a fixed slot width. It has been shown that increased dwell time is also an effective means of efficiently dewatering as well as increasing the pressure differential.

SUMMARY OF THE INVENTION

With the above background in mind, it is among the primary objectives of the present invention to provide a constant vacuum felt dewatering system where vacuum pump requirements are minimized, particularly in regard to horsepower requirements. Vacuum pump sizing is based upon a single suction pipe under new felt conditions.

It is also an objective of the present invention to provide a system whereby the felt is subjected to longer dwell times over suction pipe slots thereby increasing the efficiency of the system and achieving a greater dewatering effect.

A further objective is to provide a system with two spaced suction pipes and a slot in each pipe. The pipes are connected by conduit means to a suction applicator means such as a liquid ring pump. The felt is passed over the suction pipes and one of the pipes has a control valve operated by a controller responsive to an increase in vacuum demand in one of the suction pipes to adjust the vacuum applied to the other of the pipes.

One way of accomplishing the control means adjustment is to provide an adjustable control valve responsive to an electrical controller which in turn is responsive to a vacuum transducer connected to one of the suction pipes. A change in demand for suction causes the transducer to signal the controller which in turn operates the adjustable control valve to accordingly adjust the suction applied to the other of the suction pipes. Alternatively, well known pneumatic or mechanical equivalent control means can be used to adjust the control valve in place of the electrical control.

In the system described above, when a new felt is used at start up, the control valve is closed so that only one suction pipe is connected to the liquid ring or positive displacement pump and all dewatering is through the slot of that suction pipe. As the felt permeability decreases, the vacuum level in that one suction pump wants to increase. Through the vacuum transducer the controller senses this demand for increased vacuum and causes the adjustable control valve to open to the other of the suction pipes. A pneumatic control valve can be used for this purpose. In this manner, the felt is dewatered at two locations as it passes over one of the suction pipes and thereafter the second suction pipe with the newly opened conduit system. In one operable design of the system, by the time the felt permeability reaches approximately 50% of original value of the new felt, the control valve is wide open.

In this type of system, minimum vacuum pump requirements are present since the sizing of the vacuum pump or liquid ring pump is based upon minimum dwell time requirements under new felt conditions. When the felt becomes more difficult to dewater, that is of lower permeability, the dwell time is increased.

Dwell time is the time the felt or a given particle of felt is over the open slot. An increase in dwell time may be accomplished by either increasing the slot width or decreasing the speed of felt travel. One way this can be accomplished is by using a single suction pipe with a predetermined slot configuration under new felt conditions. When the felt becomes old, a second slot configuration is used which may include at least a second suction pipe.

In a further embodiment of the system utilizing the liquid ring pump and two suction pipes, the suction through the second pipe is regulated by use of an adjustable slot in that pipe. An appropriate mechanism is used to open and close the slot and that mechanism is responsive to a controller which in turn is responsive to a vacuum transducer at the first pipe. Once again, it has been found effective to use an electrical system whereby an electrical motor is attached to the adjustable slot and is electrically connected to a controller responsive to a change in vacuum demand in the first pipe through appropriate electrical connections. Alternatively, a pneumatic or mechanical system can be used in place of an electrical system. In use, when start up on a new felt is utilized in the system, the adjustable slot in the second pipe is at its minimum width. This provides for maximum dewatering effect through the first suction pipe by means of the liquid ring pump and minimal dewatering with respect to the second suction pipe containing the adjustable slot. Thereafter, as the felt permeability decreases in use, the vacuum level in the first suction pipe wants to increase because it is a constant value pump system. The transducer responds to this demand for increased vacuum level and the controller senses this demand and actuates a motor to open the adjustable slot to increase the vacuum level at the second pipe and thereby maintain a constant vacuum level in the system. The parameters of the system can be adjusted accordingly and it has been found effective to provide a system wherein by the time felt permeability reaches approximately 50% of the original permeability value of the new felt the adjustable slot will be equal to the non-adjustable slot width.

Once again, minimum vacuum pump requirements are achieved since the sizing is based primarily upon a single suction pipe utilized under new felt conditions. The second suction pipe only extends beyond minimum operation after the felt permeability decreases. In all of the embodiments of the present invention, the system is designed so that a minimum horsepower can be used for the liquid ring pump and when permeability decreases for the felt during use, the efficiency of the system is maintained due to the increased use of a second suction pipe to maintain the suction level through adjustment of the suction applied to the second suction pipe in coordination with reduction in felt permeability during prolonged use of a felt in a dewatering system.

A constant vacuum felt dewatering system is provided. The system includes first and second suction pipes with at least one slot in each pipe. A felt is positioned to pass over the slots of the first and second suction pipes. A vacuum producing means is connected to the first and second suction pipes by conduit means. Drive means operates the vacuum producing means to apply vacuum to the first and second suction pipes. Means is provided to advance the felt over the pipes whereupon vacuum is applied thereto to dewater the felt. Control means is provided responsive to a change in felt conditions to vary the dwell time of the felt with respect to the slots.

In summary, the system involves increasing the dwell time for new felt conditions to old felt conditions. This involves sensing a change in vacuum and providing slot adjustment and/or arrangement to maintain a substantially constant vacuum throughout felt life.

With the above objectives among others in mind, reference is made to the attached drawings.

DETAILED DESCRIPTION

Figure 1:
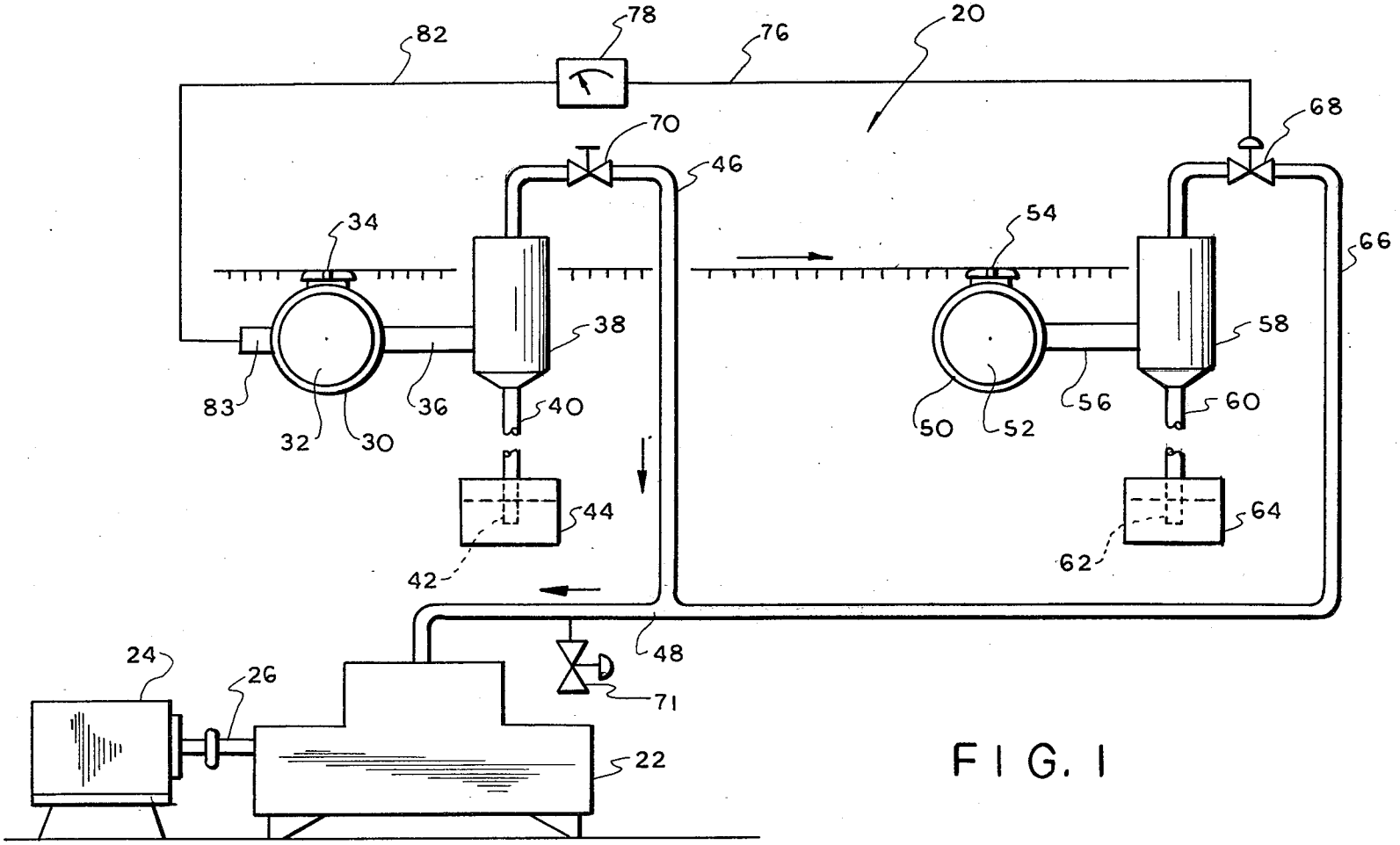
FIG. 1 is a schematic view of the dewatering system of the invention when a new felt is in use and with arrows showing the flow direction.
Figure 2:
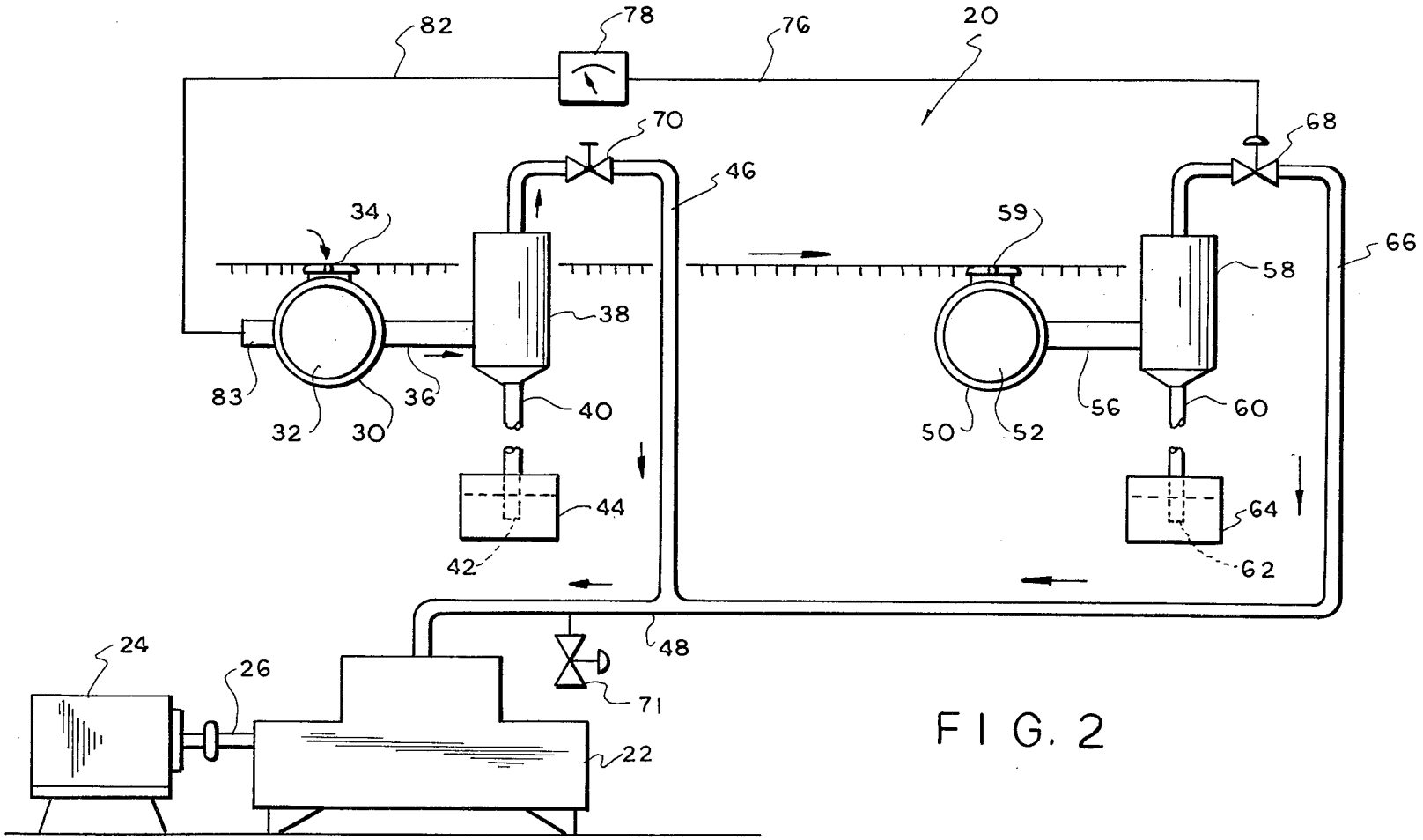
FIG. 2 is a schematic view of the system of FIG. 1 after the felt has reached a point of substantial reduced permeability with arrows showing the direction of flow.

Constant vacuum felt dewatering system 20 is depicted in FIGS. 1 and 2 which show the operation of the system with a new felt in FIG. 1 and with a felt of reduced permeability in FIG. 2.

System 20 includes a conventional well known type of liquid ring pump or other common type of vacuum pump that is a well known substitute therefor. An example is a liquid ring pump manufactured by Nash Engineering of Norwalk, Connecticut. Typical flow rates should be in the range of 2000–7000 ACFM. Liquid ring pump 22 is connected to a drive motor 24 by means of a conventional drive shaft assembly 26.

A conventional felt used in the papermaking industry is passed through the system for dewatering purposes. Arrows show the direction of movement of the felt from left to right as FIG. 1 is viewed. A conventional well known drive mechanism (not shown) can be used to advance the felt.

A first suction pipe 30 is near the beginning of the system and has a hollow interior 32. The suction pipe 30 is open at its upper end through a suction pipe slot 34. Slot 34 is open and accordingly to the felt passing thereover. Suction pipe 30 is mounted in the system in a conventional manner and has extending laterally therefrom a conduit 36 which communicates with the hollow interior 32 of pipe 30. The other end of conduit 36 communicates with the hollow interior of separator 38. A drop leg 40 extends downwardly from separator 38 and terminates at an open end 42. The open end 42 communicates with the interior of a reservoir 44.

Extending from the upper end of separator 38 is a conduit which communicates with the interior thereof and extends into communication with a conduit 48. Conduit 48 is connected to liquid ring pump 22.

Beyond suction pipe 30 in the direction of travel is a second suction pipe 50. Suction pipe 50 has a hollow interior 52 and an upwardly extending slot 54 communicating with the hollow interior 22 and with the felt passing across surface 20*a*. A lateral conduit 56 extends from suction pipe 50 to a hollow separator 58 and communicates with the interior of the separator and the hollow interior 52 of suction pipe 50. Separator 58 has a drop leg 60 extending downward with an open bottom end 62 in communication with a collection reservoir 64. Conduit 66 communicates with the interior of separator 58 and extends into integral communication with conduit 48 and thereby into communication with liquid ring pump 22.

An adjustable control valve 68, for example an electrically operable pneumatic valve, is mounted in conduit 66. Alternatively the valve can be pneumatically or mechanically operable in a well known manner. A throttling valve 70 is mounted in conduit 46 and a vacuum relief valve 71 is mounted in conduit 48 adjacent to liquid ring pump 22.

Control valve 68 is connected to a vacuum controller 78 through line 76. Controller 78 can be a conventional type of sensor responsive to changes such as changes in vacuum. Controller 78 is connected by line 82 to a vacuum transducer 83. These controls can be electrically, pneumatically or mechanically operated in a well known manner.

In operation, FIG. 1 shows the system at the time of start up when a new felt is introduced to the system to travel in the direction of the arrows. At start up with the new felt, control valve 68 is closed thereby closing the conduit pathway between suction pipe 50 and pump 22 thus there is no suction applied to slot 54 and accordingly no flow along conduit 66.

On the other hand, throttling valve 70 is open and suction is applied to slot 34 of suction pipe 30. In this manner, water is removed from the felt passing over slot 34 and drawn into the hollow interior 32 of pipe 30. The water is then drawn through conduit 36 into separator 38 where a conventional separation process takes place and water collects through drop leg 40 into reservoir 44. The suction path is continuous through conduits 46 and 48 into liquid ring pump 22 as shown by the arrows in FIG. 1.

As time passes and the felt is utilized its permeability decreases and the vacuum level in interior 32 of suction pipe 30 wants to increase. Vacuum controller 78 reacts to this and automatically opens valve 68. The resultant condition is depicted in FIG. 2. Control valve 68 is opened gradually in response to the changing vacuum condition in pipe 30 until, by the time felt permeability reaches approximately 50% of the original permeability value of the new felt, the control valve is wide open. This procedure for opening control valve 68 has been found to be effective for purposes of system 20. However, the controls can be adjusted to open the valve at any desired rate in response to vacuum demand in pipe 30 which is related to permeability of the felt.

As shown in FIG. 2, the path between liquid ring positive displacement pump 22 and slot 34 of suction pipe 32 is still open and additionally, the flow path between liquid ring pump 22 and slot 54 of suction pipe 50 is open. Accordingly, vacuum is now applied to the slots of both suction pipes to facilitate maintenance of a constant vacuum level even with reduced felt permeability and also providing for additional dewatering slot area to provide additional dwell time and increased dewatering results with felt of reduced permeability.

As discussed above, the advantages of the system include the ability to use minimum vacuum pump requirements since size is based on a single suction pipe under new felt conditions. When the felt is more difficult to dewater, that is when the permeability is decreased, the advantage of increased dwell time is achieved in view of the travel path across two suction pipes.

Figure 3:
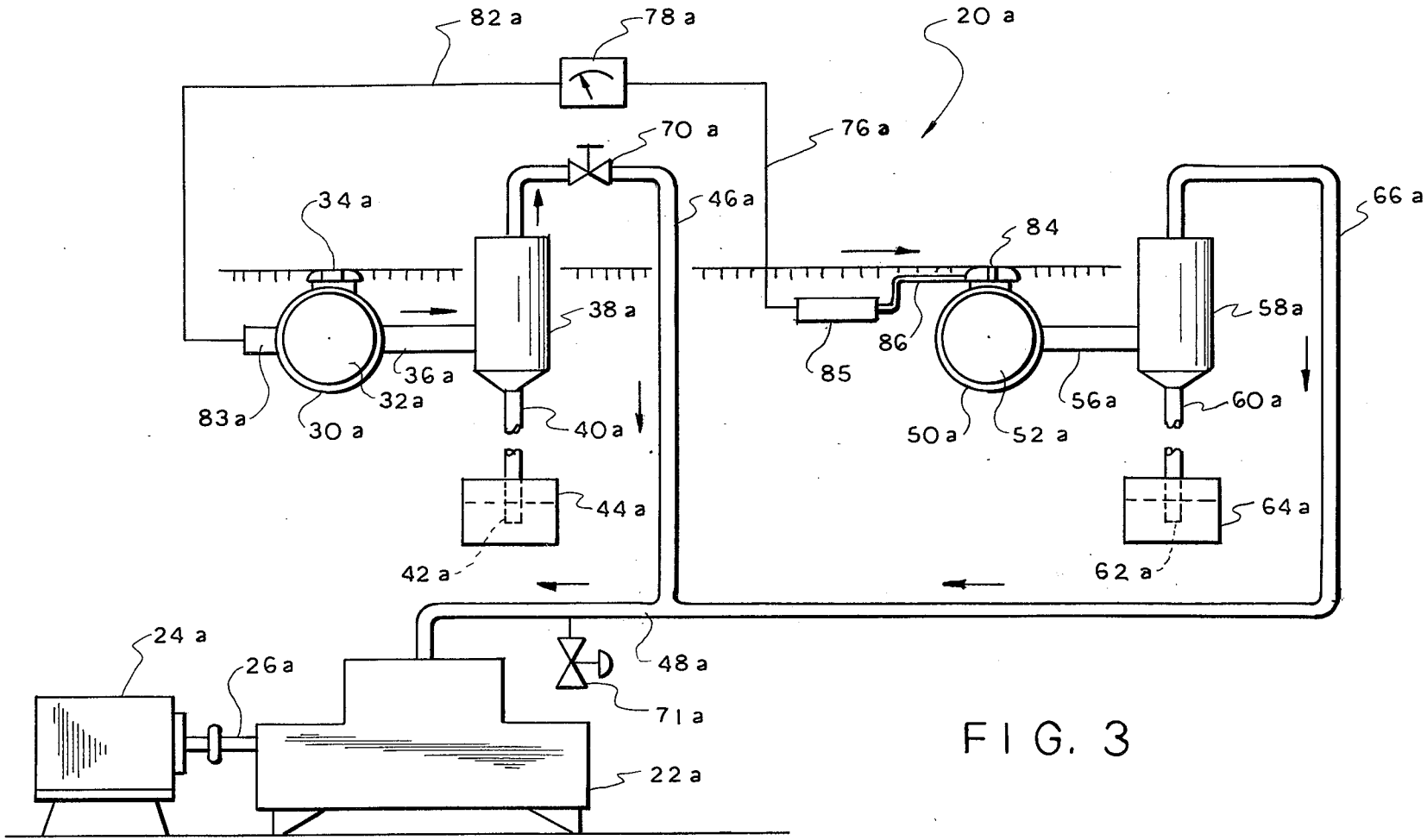
FIG. 3 is a schematic view of an alternative embodiment of the dewatering system of the invention with arrows showing the direction of flow when a new felt is in use.
Figure 4:
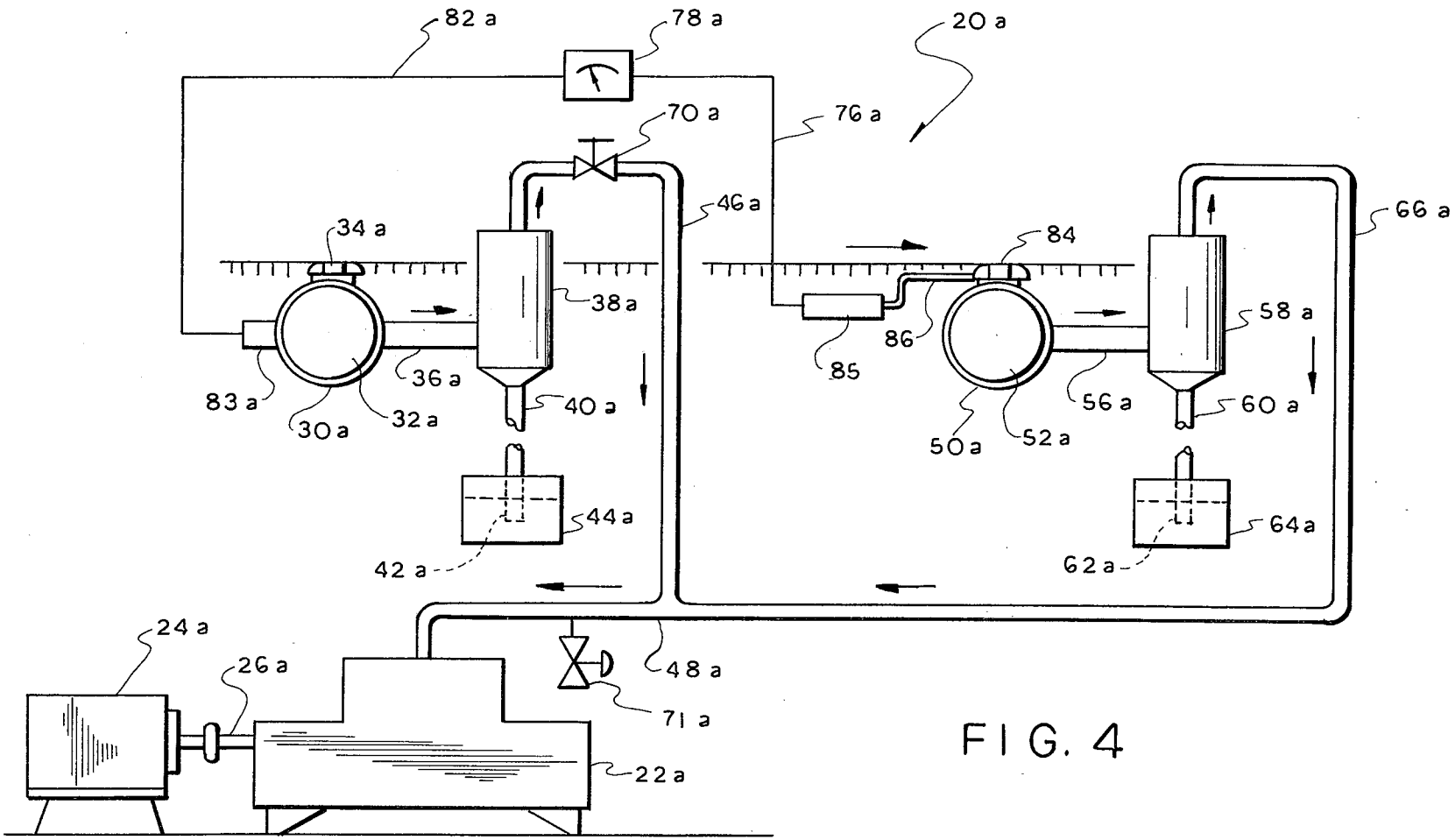
FIG. 4 is a schematic view of the dewatering system of FIG. 3 after the felt reaches a point of a substantial reduced permeability with arrows showing the direction of flow.

An alternative arrangement of the present invention is depicted in FIGS. 3 and 4. The majority of the components are the same as discussed above in connection with the embodiments of FIGS. 1 and 2 and thus similar components are given the same numbers with the addition of the subscript a.

The modifications relate to the controls for the second suction pipe 50*a*. In place of the fixed slot width 54 of the previously discussed embodiment, an adjustable slot 84 is utilized. Adjustable slot 84 is conventional, for example a mechanically shiftable structure which enables one to vary the width of the slot as desired. For purposes of varying the width of the slot, a motor 85 is provided and is connected by a conventional mechanical or equivalent connector 86 to slot 84 so that when the motor is actuated the slot is adjusted in width. Electrical conduit 76*a* is connected to controller 78*a* which in turn is connected by electrical line 82*a* to vacuum transducer 83*a*. In this embodiment, control valve 68 and the electrical actuator 72 are dispensed with.

FIG. 3 shows the embodiment in start up use with a new felt. Adjustable slot 84 is positioned at its minimum size width or opening. Thus, as the new felt passes in the direction shown by the arrows in FIG. 3, suction applied through slot 34*a* draws water from the felt into the hollow interior 32*a* of suction pipe 30*a*. The water is then passed into separator 38*a* where it is separated in conventional fashion to pass through drop leg 40*a* into reservoir 44*a*. The flow path remains open through conduit 46*a* with valve 78 open and thereafter through conduit 48*a* with relief valve 71*a* permitting flow as shown by the arrows into liquid ring pump 22*a*.

At the same time, vacuum is applied at the location of slot 84 at its minimum width to accumulate a minimum amount of water from the felt. The water is drawn into the hollow interior 52*a* of the second suction pipe 50*a* and thereafter through conduit 56*a* into separator 58*a*. Conventionally separated water passes through drop leg 60*a* to accumulate in reservoir 64*a*. Conduit 66*a* and 48*a* remain open to liquid ring pump 22*a*. The arrows of FIG. 3 show this combined flow path with respect to suction pipes 30*a* and 50*a*.

As felt permeability decreases the vacuum level in the interior 32*a* of suction pipe 30*a* wants to increase to maintain the constant volume vacuum pump system. Transducer 83*a* responds to this demand by causing controller 78*a* to sense the vacuum demand and actuate motor 85 to automatically open the adjustable slot 86 and increase the vacuum applied to the felt through that slot. The rate of opening of slot 86 is a matter of choice as with the adjustable control valve of the previously discussed embodiment and can be opened gradually in response to a change in permeability of the felt. It has been found effective to use a rate of opening of slot 86 which results in a condition wherein by the time felt permeability reaches approximately 50% of its original value the adjustable slot will be equal to the size of slot 34*a* in the first suction pipe 30*a*. This condition is depicted in FIG. 4 with arrows showing the continuous flow paths with respect to both section pipes and the elongated width of adjustable slot 86. In connection with this embodiment as with the previous embodiment, the object is to maintain a constant vacuum in the system and this is facilitated by the additional slot exposure for felt with reduced permeability. As shown by the arrows, the flow paths are the same in FIG. 4 as in FIG. 3 with the difference being in the amount of vacuum applied through slot 86 due to the size of the opening of the slot.

Once again, dwell time is the time the felt or a given particle of felt is over the open slot. An increase in dwell time may be accomplished by either increasing the slot width or decreasing the speed of felt travel. One way this can be accomplished is by using a single suction pipe with a predetermined slot configuration under new felt conditions. When the felt becomes old, a second slot configuration is used which may include at least a second suction pipe.

Naturally when the felt is to be replaced the above discussed embodiments are returned to the initial structural set up as shown in FIGS. 1 and 3. At that time, the new felt is introduced and start up conditions are produced. The cycle repeats and as the felt's permeability decreases the conditions shown in FIGS. 2 and 4 are arrived at for both discussed embodiments.

In the depicted embodiments the fixed condition suction pipe is positioned before the adjustable condition suction pipe in the direction of travel. Naturally, it would be possible to reverse or otherwise rearrange the relative positioning of the pipes.

Also, it should be kept in mind that interchangeable mechanical and electrical controls can be employed.

This same system can be applied to other industries dealing with carpets, woven and non-woven products, textiles which utilize vacuum dewatering procedures and exhibit wide variations in permeabilities.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A constant vacuum felt dewatering system comprising; a first and a second suction pipe each having a slot therein, a felt positioned to pass over the slots, vacuum means including a positive displacement pump which provides a relatively constant volume of air flow at the pump, conduit means connecting the suction pipes to the vacuum means, means to advance the felt over the pipes whereupon vacuum is applied thereto to dewater the felt, and means for sensing a demand for increased vacuum and control means for maintaining a substantially constant vacuum under varying air flow conditions through the felt including an automatic control valve positioned in the conduit means between the second suction pipe and the vacuum means, a vacuum controller connected to the control valve, and wherein the means for sensing the demand for increased vacuum is operatively connected to the first suction pipe and the vacuum controller.

2. The invention in accordance with claim 1 wherein the conduit means between the first suction pipe and the vacuum means further includes a separator for water drawn from the felt, a drop leg from the separator to a reservoir for collection of the removed water, and a throttling valve to enable control of the flow path through the conduit means between the first suction pipe and the vacuum means.

3. A method of providing a constant vacuum felt dewatering system comprising; providing first and second suction pipes each having a slot therein, connecting the suction pipes to a source of vacuum including a positive displacement pump which provides a relatively constant volume of air flow at the pump to apply suction to the suction pipes, advancing a felt over the slots of the suction pipes whereupon suction is controlling the suction by an automatic control valve in the conduit between the second suction pipe and the vacuum means, and a controller for the control valve whereby the sensed demand for increased vacuum in the first suction pipe actuates the control valve and correspondingly changes the suction applied to the slot of the second suction pipe in order to maintain a constant vacuum under varying air flow conditions through the felt.

4. The invention in accordance with claim 3 wherein the control valve is initially closed at the time of use of a new felt, and upon decrease of felt permeability during use and corresponding increase in the demand for vacuum in the first suction pipe sensing the increased demand for vacuum at opening the control valve and the conduit to the second suction pipe so that additional suction is applied to the slot of the second suction pipe.

5. The invention in accordance with claim 3 wherein the control valve is in the fully open position when the felt permeability reaches approximately 50% of the permeability value of the new felt.

6. A constant vacuum felt dewatering system comprising; first and second suction pipes each having a slot therein, a felt positioned to pass over the slots, vacuum means including a positive displacement pump which provides a relatively constant volume of air flow at the pump, conduit means connecting the suction pipes to the vacuum means, means to advance the felt over the suction pipes whereupon vacuum is applied thereto to dewater the felt, means for sensing a demand for increased vacuum and means responsive to the sensed demand for increased vacuum for automatically controlling slot width adjustment and/or arrangement to vary the dwell time in order to maintain a substantially constant vacuum under varying air flow conditions through the felt, the second suction pipe having means for adjusting the slot width, slot drive means attached to said adjusting means to open and close the slot as desired, said sensing means connected to the slot drive means and to the first suction pipe.

7. The invention in accordance with claim 6 wherein the slot drive means is a motor.

8. The invention in accordance with claim 6 wherein the slot width of the adjustable slot is designed to be equal to the size of the slot of the first suction pipe when the felt permeability reaches approximately 50% of the felt permeability of a new felt.

9. The invention in accordance with claim 6 wherein the conduit means between the first suction pipe and the vacuum means further includes a separator to facilitate collection of the water removed from the felt, a drop leg extending from the separator into a reservoir to collect the separated water, and a throttling valve in the conduit means to control flow through the conduit means between the first suction pipe and the vacuum means.

10. The invention in accordance with claim 6 wherein the conduit means between the second suction pipe and the vacuum means further includes a separator to separate water collected from the felt and a drop leg extending from the separator into communication with a reservoir to collect the separated water.

11. A method of providing a constant vacuum felt dewatering system comprising; providing first and second suction pipes each having a slot therein, connecting the suction pipes to a source of vacuum including a positive displacement pump which provides a relatively constant volume of air flow at the pump to apply suction to the suction pipes, advancing a felt over the slots of the pipes whereupon suction is applied thereto to dewater the felt, sensing a demand for increased vacuum and automatically controlling the slot width adjustment and/or arrangement in response to the sensed vacuum demand to vary the dwell time in order to maintain a substantially constant vacuum under varying air flow conditions through the felt, the suction at the second suction pipe is controlled by an adjustable slot on the second suction pipe and slot drive means attached to the slot to open and close the slot in response to the sensed demand for increased vacuum.

12. The invention in accordance with claim 11 wherein the adjustable slot of the second suction pipe is at its minimum opening when a new felt is used in the system and as the permeability of the felt decreases the result in demand for increased vacuum level in the first suction pipe is sensed whereupon the controller activates the slot drive means to open the adjustable slot of the second suction pipe.

* * * * *

UNITED STATES PATENT AND TRADEMARK OFFICE

CERTIFICATE OF CORRECTION

PATENT NO. : 4,329,201

DATED : May 11, 1982

INVENTOR(S) : JOSEPH A. BOLTON

It is certified that error appears in the above-identified patent and that said Letters Patent are hereby corrected as shown below:

Col. 8, line 2, after "suction is", insert --applied thereto to dewater the felt, sensing a demand for increased vacuum and--.

Signed and Sealed this

*Twenty-first* Day of *September 1982*

[SEAL]

*Attest:*

GERALD J. MOSSINGHOFF

*Attesting Officer*

*Commissioner of Patents and Trademarks*